US005308280A

United States Patent [19]

Dotson

[11] Patent Number: 5,308,280

[45] Date of Patent: May 3, 1994

[54] METHOD AND APPARATUS FOR SUPPORTING VENTILATION CURTAINS IN COAL MINES

[75] Inventor: Clyde H. Dotson, McCarr, Ky.

[73] Assignee: Curtain Buddy Corp., McCarr, Ky.

[21] Appl. No.: 990,065

[22] Filed: Dec. 14, 1992

[51] Int. Cl.[5] ..... E21F 17/00

[52] U.S. Cl. ..... 454/170; 160/368.1

[58] Field of Search ..... 160/327, 330, 368.1; 454/169, 170

[56] References Cited

U.S. PATENT DOCUMENTS

| | | | |
|---|---|---|---|
| 1,778,979 | 10/1930 | Lockhart | 454/170 |
| 1,790,861 | 2/1931 | Harvey | 160/368.1 |
| 2,198,123 | 4/1940 | McCoy | 160/84.1 E |
| 2,470,318 | 5/1949 | Nadelson | 160/327 X |
| 2,947,239 | 8/1960 | Burgess | 454/170 |
| 3,118,363 | 1/1964 | Burgess, Jr. | 454/170 |
| 3,455,366 | 7/1969 | Bogumil | 160/368.1 |
| 3,715,969 | 2/1973 | Burgess, Jr. . | |
| 3,863,554 | 2/1975 | Boyd | 454/170 |
| 4,180,352 | 12/1979 | Divers et al. | 454/170 X |
| 4,282,802 | 8/1981 | Divers et al. | 454/170 |
| 4,440,070 | 4/1984 | Baker et al. | 454/170 |
| 4,708,189 | 11/1987 | Ward | 160/330 X |
| 4,770,086 | 9/1988 | Gabster | 454/170 |

FOREIGN PATENT DOCUMENTS

| | | | |
|---|---|---|---|
| 1230748 | 12/1966 | Fed. Rep. of Germany | 434/169 |
| 1640439 | 4/1991 | U.S.S.R. | 454/170 |

*Primary Examiner*—Harold Joyce
*Attorney, Agent, or Firm*—Howrey & Simon

[57] ABSTRACT

A hanger for a coal mine ventilation curtain has a support that is compressed against the mine surface, trapping the edge of a sheet of ventilation curtain material between a curtain supporting portion of the support and the mine surface. The support can be held in its compressed position against the mine surface by a tension member, such as a chain, that is attached to the mine surface (most readily at a roof plate) and is then secured to the support. Alternatively, the support can be held in place from the side of the support opposite the mine surface by a compression member (such as an adjustable support pole).

11 Claims, 5 Drawing Sheets

METHOD AND APPARATUS FOR SUPPORTING VENTILATION CURTAINS IN COAL MINES

BACKGROUND OF THE INVENTION

The invention relates generally to mine ventilation control, and specifically to a method and apparatus for supporting ventilation curtains in mine entries.

In mining coal underground, the room and pillar method of mining is often used. As shown in FIG. 1, mine sections are usually constructed with multiple parallel entries 10, extending from the opening 12 of the section to the face 14 of the mine where the coal or other material is being cut. As the coal is mined, dust and gases are liberated at the face 14, which, if left to accumulate, could build up to form explosive or otherwise harmful concentrations. Accordingly, ventilation systems are used to remove escaping gases and/or dust. Typically, at least one of the entries 10 serves as an intake air course to provide ventilation to the face 14, while other entries provide return air courses and neutral entries for belt and trolley haulage to convey the mined material from the face of the mine. As the face of the mine advances, transverse crosscuts 16 are placed approximately every 80' (25 m) (this distance may vary from 40' to 90' (13 m to 29 m), or over a greater range, depending on applicable regulations and exceptions) to provide communication between the entries 10 and thus ventilation across the entire mine face 14. The axially-extending entries 10 and spaced transverse crosscuts 16 thus define pillars 18 extending along the entire mine section.

To assure delivery of fresh air to the mine face 14 at an adequate velocity, a pressure differential must be established between the intake and return air courses (typically by a mine fan), as well as the haulage courses. Therefore, the crosscuts 16 must be blocked by placing stoppings 22 across each crosscut from pillar to pillar and floor to ceiling. Most of the stoppings 22 are of permanent construction (such as cement and cinder block), while, be regulation, the stoppings in the last two crosscuts closest to the mine face (as at 23) may be temporary stoppings of less durable construction, typically of sheets of fire-resistant, gas impervious material.

To ensure that the ventilating air does not return along intermediate entries 10, the entries (other than the intake and return air courses) are blocked by check curtains 24 between the pillars 18 closest to the face 14. The check curtains have flaps that open to permit passage of workers and equipment then close to maintain an air seal. Finally, to provide adequate flow directly across the face 14, line curtains 26 are placed to extend from the face to the pillars 18 closest to the face. Thus, ventilating air A can flow down the intake course, along and around the end of line curtains 26, across the face 14, and out along the return course.

A variety of techniques are known for constructing these ventilation structures. One portable stopping construction is disclosed in U.S. Pat. No. 3,863,554 to Boyd. The portable stoppings 38 are formed of flexible sheet 40 supported on a frame structure 41 between the roof, floor, and side ribs of the crosscuts 35. The frame 41 is formed of telescoping vertical support rods 42, horizontal support rods 43, and diagonal support rods 44, while the perimeter of the frame 41 is defined by metal straps 45. The edges 46 of the sheet 40 are folded over the strap 45 so that several layers of the sheet are trapped between the strap and the adjacent mine surface S.

When the support rods 42, 43, and 44 are extended by jacks, the straps press the layers against the mine surface to form a seal. Spikes 48 can also be used to penetrate the straps, sheet material, and mine surface to retain the straps and sheet material to the mine surface. The system of support rods and straps is complex and cumbersome, and the spikes damage the sheet material, limiting the number of times the material can be reused.

Several techniques are known for suspending sheet materials for use as stoppings, check curtains, and line curtains. U.S. Pat. No. 1,778,979 to Lockhart discloses a curtain formed of fabric strips 31 with a reinforcing member 32 (such as a wire) extending along the top end the strip. Holes are drilled in the roof of the mine and wooden plugs driven into the holes. Staples are then driven into the wooden plugs, the staples straddling the reinforcing wire 32 and holding the top of the fabric strips against the mine roof. In U.S. Pat. No. 2,947,239 to Burgess, the top of the curtain material is provided with grommets that are mounted on hooks secured to the mine's supporting timbers. These techniques rely on the presence of supporting timbers and the placement of hooks or on the cumbersome and time-consuming process of drilling holes and placing wooden plugs, and require specialized curtains.

U.S. Pat. No. 3,118,363 to Burgess discloses a spring-loaded, two-piece supporting assembly 12 fitted with spikes 30 and 36 at the top and bottom to engage the roof and floor of the mine, respectively. The supporting assembly is also fitted with a hook 48 that engages grommets fitted to the top edge of the sheet 10. A series of supporting assemblies are fitted vertically between the roof and floor of the mine, and the sheet 10 hung from the hooks 48. Again, this technique requires grommeted sheet material and supporting assemblies that are relatively expensive.

A simpler known technique is to simply nail the edges of the sheet material to the mine surface or between the upper edge of a roof plate and the mine ceiling. However, this technique produces holes in the material that shortens its useful life. This technique also requires the use of hammer and nails, which complicate the installation process and add the risk of injury to the installer and damage to mining vehicle tires, and the nails do not reliably hold the curtain in place.

Several extensible line curtain structures have been proposed to permit line curtains to be readily extended toward the mine face. Examples include: U.S. Pat. No. 3,715,969 to Burgess; U.S. Pat. Nos. 4,180,352 and 4,282,802 to Divers, et al.; U.S. Pat. No. 4,440,070 to Baker, et al.; and U.S. Pat. No. 4,770,086 to Gabster. All of these structure are complex and expensive.

SUMMARY OF THE INVENTION

The drawbacks of the prior art are overcome by the method and apparatus of the invention. A curtain hanger has an elastically deformable support that is compressed against the mine surface, trapping the edge of a sheet of ventilation curtain material between a curtain supporting portion of the support and the mine surface. The support can be held in its compressed position against the mine surface by a tension member, such as a chain, that is attached to the mine surface (most readily at a roof plate) and is then secured to the support. Alternatively, the support can be held in place from the side of the support opposite the mine surface by a compression member (such as an adjustable support pole). The apparatus and method of the invention requires no tools for installation of the ventilation curtain, and requires only plain sheet material, without special grommets or reinforcing wires. No special support structures need to be added to the mine—the hanger can be used with a roof support plate (present in virtually all mines) or can be used with the compression member alone. The hanger is readily removable and reusable, and does not damage the curtain material, so that the material can be reused many times.

DETAILED DESCRIPTION

Figure 1:
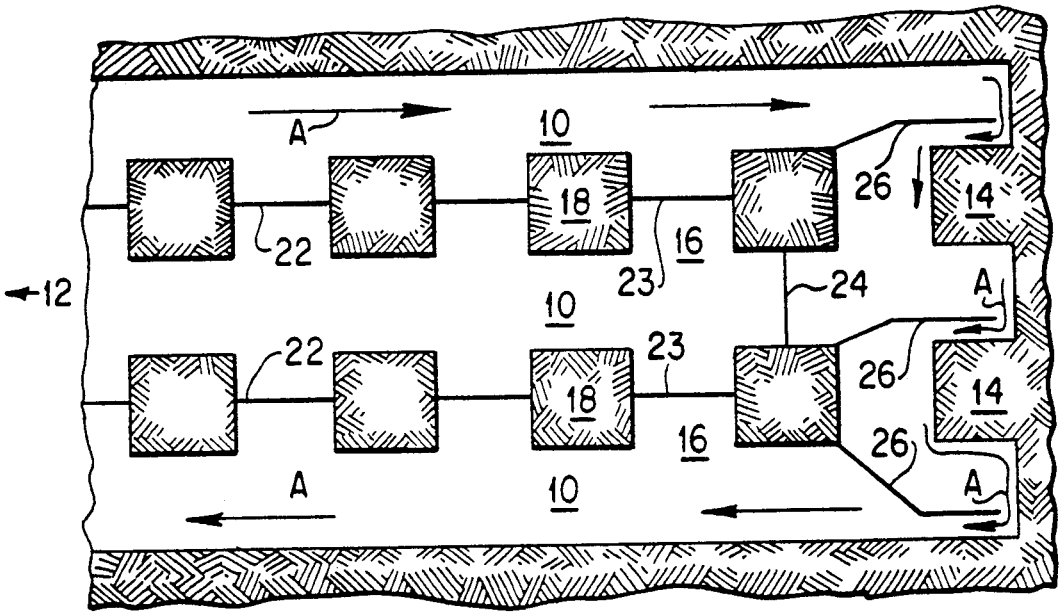
FIG. 1 is a schematic plan view of a mine in which the invention may be used.

A first embodiment of the invention is illustrated in FIGS. 2A–D. The curtain hanger 100 includes a support 110 formed from a sheet of high carbon, heat treated spring steel. The support 110 is bent into a continuous arcuate shape (before heat treating) to form a body portion 114, curtain supporting portions 112, and handle portions 116. Suitable dimensions for the support 110 are: L1=12" (31 cm); W1=3" (8 cm); D1=3.5" (9 cm); R1=4.5" (12 cm); R2=1" (2.5 cm); and T1=0.0625" (1.6 mm). A key-hole shaped slot 120 is formed in the center of the body portion 114. A tension member 130, in the illustrated embodiment a chain, is attached at one end to the body portion by an S-hook 132 engaged in a hole 122 formed at the edge of the body portion and crimped closed around the chain and the edge of the body portion. A roof plate hook 134 is attached to the other end of the chain 130, and is also crimped around the chain. Preferably, the chain 130 is approximately 7" (18 cm) of #35 sash chain, S-hook 132 is a #12 S-hook, and roof plate hook 132 is formed of 0.135" (3.5 mm) steel wire. The support 110 is entirely coated in a vinyl coating to prevent corrosion, make the support easier to handle, and provide electrical insulation from electrical cables that may contact the support.

Figure 3:
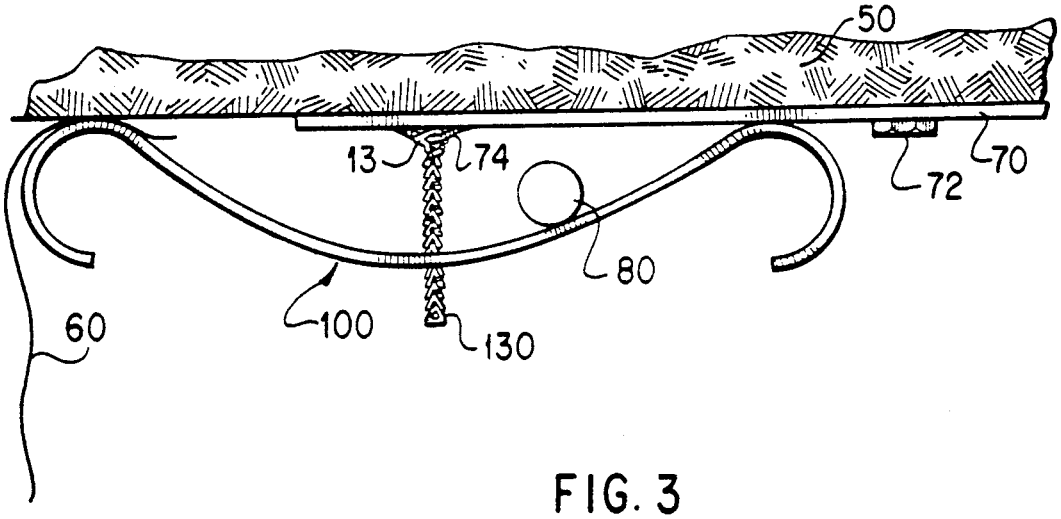
FIG. 3 is an elevation view of the hanger of FIGS. 2A–C mounted to a roof plate and supporting a ventilation curtain.
Figure 2D:
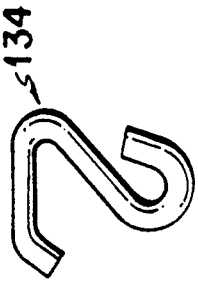
FIG. 2D illustrates a roof plate hook used with the hanger shown in FIGS. 2A–C.
Figure 2C:
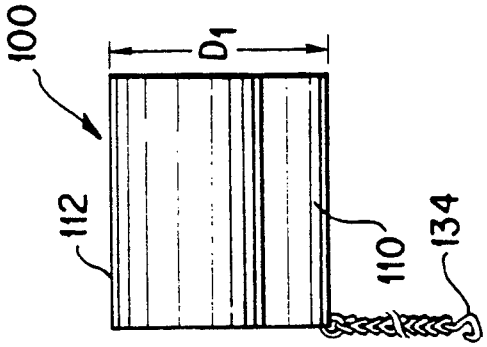
FIGS. 2A–C are plan, side elevation, and end elevation views of a first embodiment of a curtain hanger.
Figure 2A:
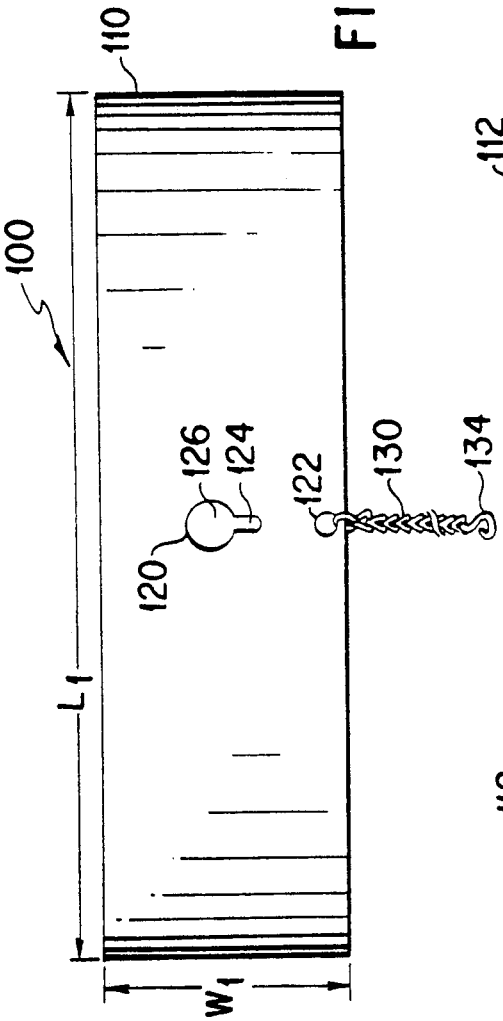
Figure 2B:
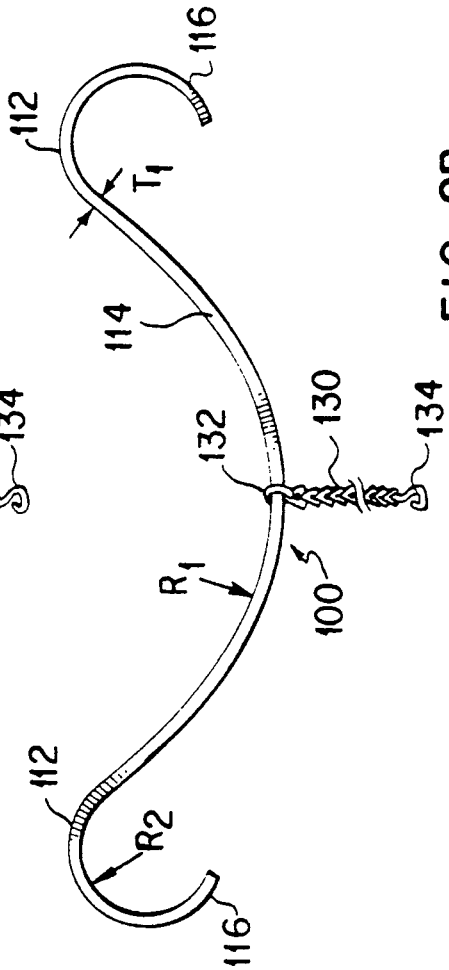

As shown in FIG. 3, the curtain hanger 100 is mounted to the roof 50 of the mine to suspend a curtain 60 (which may be used as a line curtain, check curtain, or temporary stoppage). Material commonly used for such curtains is Koroseal Clear Brattice Cloth No. 64-3703172-00, manufactured by the B. F. Goodrich General Products Company, Marietta, Ohio. Mines customarily employ steel roof plates 70 bolted to the mine roof 50 by bolts 72 to anchor the layers of rock or other material at the surface of the roof and prevent them from collapsing into the mine. The plates have one or more mounting loops or holes 74 punched from the plate. The curtain hanger 100 is mounted to the roof 50 by connecting the roof plate hook 134 to the roof plate hole 74, with the chain 130 passing through the larger portion 126 of the slot 120. The curtain supporting portions are placed into contact with the roof 50 and/or the roof plate 70, and the body portion 114 pressed toward the roof 50. The force applied to the body portion flattens the body portion and is transmitted to the roof 50 through the curtain supporting portions 112.

The desired degree of compression of the support 110 against the roof is fixed by sliding the chain 130 laterally into the narrower portion 124 of the slot 120—the chain links are too large to pass through the narrower portion 124. The compressed support 110 pulls down against the chain 130, pulling it taught and locking the chain tightly against the underside of the body portion 114 about the narrower portion 124 of the slot 120.

Either one of the curtain supporting portions 112 can then be pulled downwardly, out of contact with the roof 50 or roof plate 70, by pulling on the corresponding handle portion 116, the upper edge of the curtain 60 placed therebetween, and the handle portion 116 released, trapping the curtain 60. The curtain 60 is then securely suspended from the hanger 100. Alternatively (although more awkward), the ventilation curtain can be placed between the roof and the curtain supporting portion before the support is compressed against the roof. The curtain and hanger can be removed by repeating the above process in reverse order.

Similarly, other mine equipment, particularly wire or cabling 80 for power or lighting, can be supported on the upper surface of body portion 114 by deflecting a curtain supporting portion 112 away from the roof 50, passing the cable 80 therebetween, and releasing the curtain supporting portion 112.

The curtain 60 is subject to tensile loads imposed by vehicles rolling onto the lower edge of the curtain, or workers pulling on the curtains to dislodge them from the hanger. The amount of compressive force with which the curtain is held against the mine surface is preferably such that the curtain will pull out from between the hanger and the mine surface before the curtain will rip when a high tensile load is applied to the curtain. An appropriate compressive force is approximately 20 to 40 lbf (90 to 180N). The tension member 130 is thus appropriately sized to be able to sustain this load—for example, the sash chain described above has a rating of 115 lbf (510N).

Figure 4C:
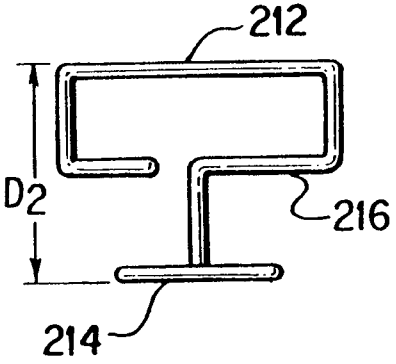
FIGS. 4A–C are plan, side elevation, and end elevation views of a second embodiment of a curtain hanger.
Figure 4A:
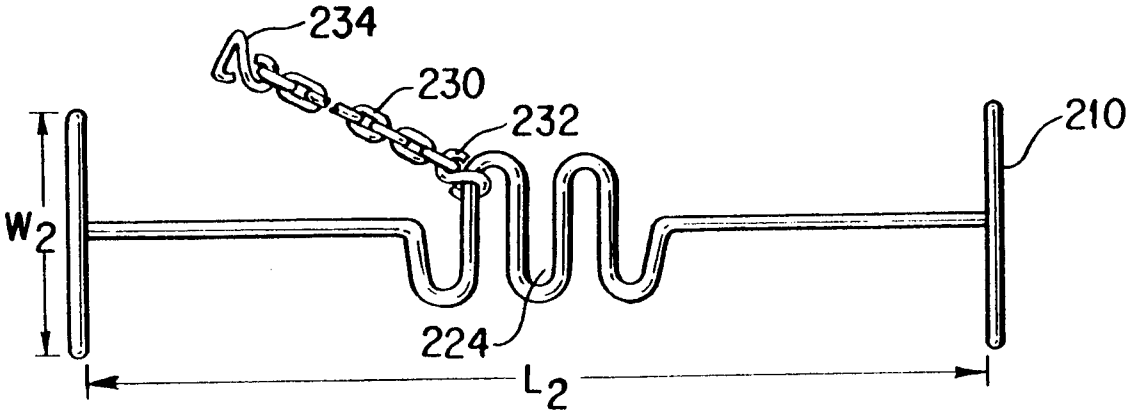
Figure 4B:
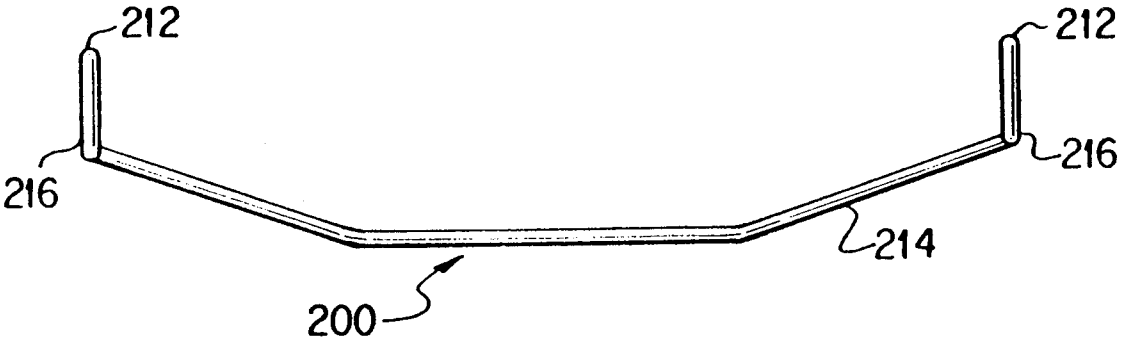

A second embodiment of a curtain hanger is shown in FIGS. 4A–C. The curtain hanger 200 includes a support 210 formed from a rod (of square or circular cross section) of high carbon, heat treated spring steel. The support 210 is bent (before heat treatment) into a continuous shape to form a body portion 214, curtain supporting portions 212, and handle portions 216. Suitable dimensions for the support 110 are: L2=12" (31 cm); W2=4" (10 cm); D2=4" (10 cm); and T2=0.25" (6.4 mm). A series of bends are formed in the middle of the body portion, with a slot 224 being formed between adjacent bends. A chain 230 is attached at one end of the body portion by an S-hook 232 hooked (and bent closed) about the body portion. A roof plate hook 234 (identical to the hook 134 shown in FIG. 2D) is attached to the other end of the chain 230. Preferably, the chain 230 is approximately 7" (18 cm) of 0.0625" (1.6 mm) mechanic's chain., and S-hook 132 is a #12 S-hook. The support is coated with a vinyl coating, as with the embodiment described above. The support is dipped in the vinyl coating material after the S-hook 132 is attached, so that the hook is also coated, and is fixed in place on the support by the coating. Curtain hanger 200 is used in the same manner as is hanger 100 in FIG. 3.

As will be apparent to the artisan, the two hanger designs illustrated and described above are subject to variations in shape, materials, dimensions, etc. The tension member used to pull the support body portion toward the mine roof may be cable, rope, etc., provided that suitable means are included for engaging the tension member to the hanger to hold the hanger compressed against the roof, such as knots or other protrusions on the tension member or a cleat in the hanger.

Figure 5:
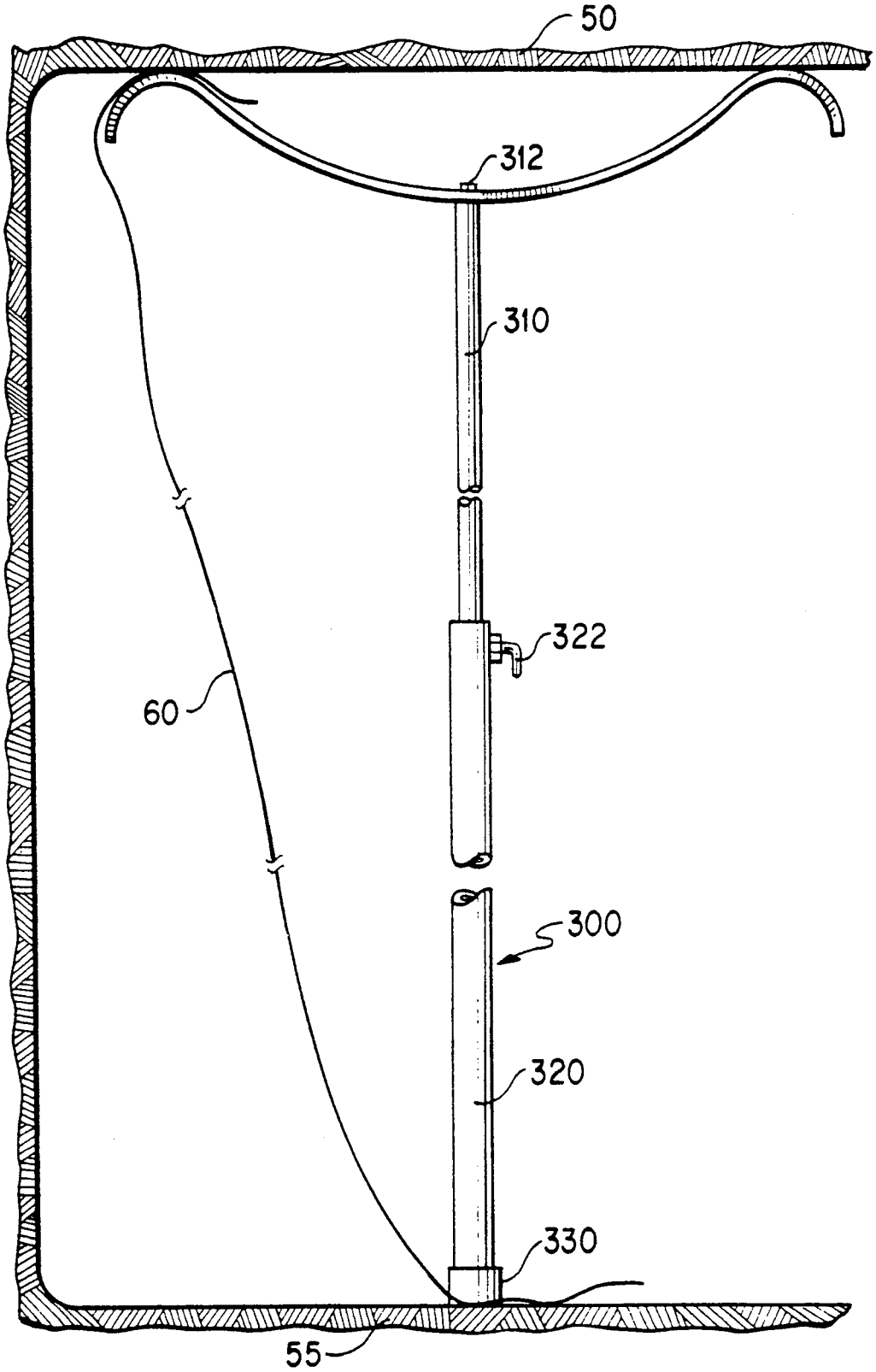
FIG. 5 is an elevation view of the curtain support of FIGS. 2A–C held against the mine roof by a support pole and supporting a ventilation curtain.
Figure 6A:
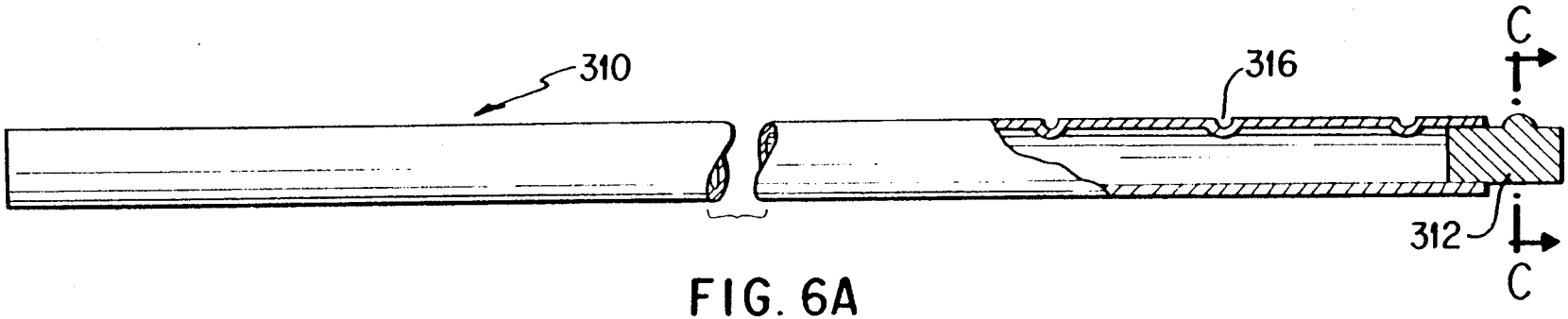
FIGS. 6A–C further illustrate the support pole of FIG. 5.
Figure 6B:
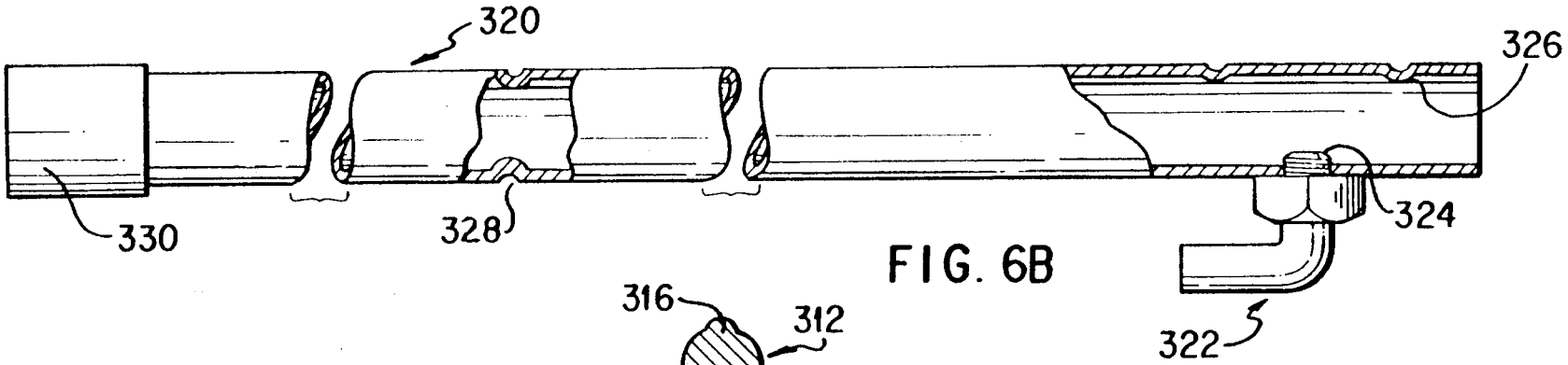
Figure 6C:
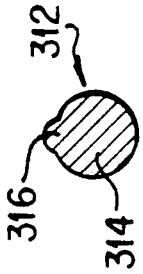

The curtain hangers of the two embodiments described above can be used in an alternate way to hang ventilation curtains. The chains 130, 230 (and associated hooks) can be omitted, and, as shown in FIG. 5, the supports 110, 210 can be pressed against the mine roof 50 with a compression member or support pole 300, further illustrated in FIGS. 6A–C. Support pole 300 is preferably constructed with an upper pole section 310 and a lower pole section 320. In the illustrated embodiment, the upper pole section telescopes within the lower pole section, so that the overall length of the support pole can be adjusted. Both sections are square in cross section, the upper pole section having an outside dimension of 0.5" (1.25 cm) and the lower pole having an outside dimension of 0.75" (1.87 cm), both sections having a wall thickness of 0.065" (1.6 mm) and being formed of steel.

A fitting 312 is attached to the upper end of upper pole section 310. The fitting is shaped to cooperate with the key-hole shaped slot 120 of the hanger 100 or the slot 220 of hanger 200. The fitting 312 includes a cylindrical post 314 with a diameter of approximately 0.375" (9.6 mm) and a protuberance which may be formed by stamping the fitting from soft steel. The protuberance 316 is sized to pass through the narrow part of the key-hole slot and extend above the upper surface of the support 110 or 210, so that when the support pole is twisted about its axis, and the protuberance is thus no longer aligned with slot, and locks the support pole to the support.

The inside surface of the lower pole section 320 and the outside surface of the upper pole section 310 are formed with cooperating recesses 316 and protrusions 326, spaced approximately 1.25" (32 mm) apart axially along the sections. The recesses on upper pole section 310 extend along the entire length of the section, while the lower pole section has only protrusions at its upper end. A locking bolt 322 is fitted to the upper end of lower pole section 320 opposite the protrusions 326. Finally, a plastic or rubber tip 330 is fitted to the lower end of lower pole section 320.

The support pole can be adjusted between a fully extended length (upper pole section 310 extending fully out of lower pole section 320) and a fully collapsed length (upper pole section nested fully into lower pole section). The lengths of the two sections are selected so that the pole can span the typical distance between the floor 55 and roof 50 of the mine in which the pole will be used. Mine roof heights may vary from 28" (72 cm) to 17' (5.2 m). Thus, for use in mines with a roof height between 28" (72 cm) and 50" (127 cm), a 25" (64 cm) upper pole section is used with a 24" (61 cm) lower pole section (giving a range pole heights of 25" (64 cm) to 48" (122 cm). For a roof height of between 44" (113 cm) and 85" (218 cm), a 42" (108 cm) upper pole section can be used with a 41" (105 cm) lower pole section. For roof heights greater than 85" (218 cm), longer lower pole sections may be used with the 42" (108 cm) upper pole section. When longer lower pole sections are used, a pair of opposed protrusions 328 may be formed on the inner surface of the lower pole section to prevent the upper pole section from sliding completely inside the lower pole section. The protrusions 328 are formed approximately 41" (105 cm) below the upper end of the lower pole section, and the distance between them is less then the outside dimension of the upper pole section.

As shown in FIG. 5, to use the support pole to hold the curtain hanger 100 or 200 against the mine roof 50, the appropriate length for the pole is selected by placing the support pole into position beneath the mine roof, and sliding the upper pole section 310 into or out of lower pole section 320 until the fitting 312 is as close as possible to the mine roof. The upper pole section is then slid down into the lower pole section approximately 1" (2.5 cm) or until the next alignment of protrusions 326 and recesses 316. The appropriate length is thus slightly less than the distance from the mine floor 55 to the mine roof 50, to accommodate the compressed height of the hanger. The selected length is then fixed by tightening the locking bolt 322, which presses against the side of the upper pole section opposite the recesses 316 and urges the recesses into locking engagement with the protrusions 326. The fitting 312 is then inserted into the slot 120 or 220 of the hanger, twisted slightly to lock the hanger to the fitting, and the hanger is placed in the desired position on the roof 50. The support pole 300 is then pushed toward the roof, compressing the hanger against the roof, the lower end of the support pole is swung under the upper end so that the pole is vertical, and the pole is then allowed to be forced by the hanger down against the mine floor 55. The hanger is thus compressed tightly against the roof 50, and the pole is fixed between the hanger and the floor 55. The upper edge of the curtain 60 can then be placed between the hanger and the mine roof, as described above. The curtain's lower edge can also be placed between the tip 330 and the mine floor by lifting the pole slightly, sliding the edge of the curtain underneath it, and letting the pole down onto the curtain. The tip protects the curtain from damage by the lower end of the lower pole section.

As well be apparent to the artisan, the illustrated support pole 300 is only one preferred design. Many other designs would be suitable, including those with different cross sections, formed of different materials, and having different adjustment mechanisms. The pole need only have sufficient strength to compress the hanger against the roof without buckling, and is preferably adjustable in length to accommodate variations in the roof's height.

While it is generally preferable (from the standpoint of simplicity and cost) to use a tension member rather than a compression member to support the hanger, the compression member is preferable for placement of a hanger where no roof plates are available to which to attach the tension member, such as near the corner of the roof and a wall. Using either the tension or compression member, the hanger can be placed against the roof, wall, or floor of the mine.

What is claimed is:

1. Apparatus for suspending a ventilation curtain from a surface of a mine, the mine surface having a roof plate with a loop, comprising:

a spring support having a curtain supporting portion adjacent the mine surface and a body portion spaced from the mine surface;

chain having a hook fixed to one end thereof, said hook being releasably engageable with the roof plate loop and said chain being engageable with said body portion to pull said body portion toward the mine surface to yieldably urge said curtain supporting portion toward the mine surface and trap the curtain between said curtain supporting portion and the mine surface, said body portion including means for engaging said chain.

2. The apparatus of claim 1 wherein said body portion is arcuate and disposed with its concave side toward the mine surface and said curtain supporting portion is disposed at one end of said body portion.

3. The apparatus of claim 2 wherein said body portion is formed of a sheet of spring steel and said chain engaging means comprises a slot through said body portion.

4. The apparatus of claim 2 wherein said body portion is formed of spring steel wire and said chain engaging means comprises a bend in said wire.

5. The apparatus of claim 2 wherein said support further includes a handle portion disposed adjacent said curtain supporting portion.

6. Method for suspending a ventilation curtain from a mine surface, the mine surface having a roof plate with a loop, comprising the steps of:

placing a support having a curtain supporting portion and a body portion near the mine surface, with said curtain supporting portion adjacent the mine surface and said body portion spaced from the mine surface;

releasably securing a hook fixed to one end of a chain to the roof plate loop;

urging said body portion toward the mine surface into a compressed position;

engaging said chain with said body portion to hold said body portion in said compressed position; and placing an edge of the ventilation curtain between the mine surface and said curtain supporting portion.

7. The method of claim 6 wherein said body portion is arcuate and disposed with its concave side toward the mine surface and said curtain supporting portion is disposed at one end of said body portion.

8. The method of claim 7 wherein said body portion is formed of a sheet of spring steel and said body portion includes a slot to engage said chain.

9. Apparatus for suspending a ventilation curtain from a surface of a mine, the mine surface having a roof plate with a loop, comprising:

a spring support having a curtain supporting portion adjacent the mine surface and a body portion spaced from the mine surface;

a flexible tension member having a hook fixed to one end thereof, said hook being releasably engageable with the roof plate loop and said flexible tension member being engageable with said body portion to pull said body portion toward the mine surface to yieldably urge said curtain supporting portion toward the mine surface and trap the curtain between said curtain supporting portion and the mine surface said body portion including means for engaging said flexible tension member.

10. The method of claim 9 wherein said flexible tension member comprises a cable.

11. The method of claim 9 wherein said flexible tension member comprises a rope.

* * * * *